US009066183B2

(12) United States Patent
Kano

(10) Patent No.: US 9,066,183 B2
(45) Date of Patent: Jun. 23, 2015

(54) PIEZOELECTRIC SPEAKER

(75) Inventor: Sawako Kano, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 360 days.

(21) Appl. No.: 13/377,332

(22) PCT Filed: Apr. 14, 2011

(86) PCT No.: PCT/JP2011/002201

§ 371 (c)(1),
(2), (4) Date: Dec. 9, 2011

(87) PCT Pub. No.: WO2011/129116

PCT Pub. Date: Oct. 20, 2011

(65) Prior Publication Data

US 2012/0082326 A1 Apr. 5, 2012

(30) Foreign Application Priority Data

Apr. 15, 2010 (JP) ..... 2010-094053

(51) Int. Cl.
*H04R 25/00* (2006.01)
*H04R 17/00* (2006.01)

(52) U.S. Cl.
CPC ..... *H04R 17/00* (2013.01)

(58) Field of Classification Search
CPC .... H04R 17/00; H04R 2307/023; H04R 1/24; H04R 2240/05; H04R 5/02; H04R 7/045; H04R 17/005; H01L 41/083; H01L 41/0973; H01L 41/042; H01L 41/0536; H01L 41/0815; H01L 41/0825; H01L 41/0833; H01L 41/1873; H01L 41/1876; H01L 41/1878
USPC ..... 381/190, 152, 191; 310/317, 322, 324, 310/340, 348, 358
See application file for complete search history.

(56) References Cited

U.S. PATENT DOCUMENTS 6,453,050 B1 9/2002 Ogura et al.
6,865,785 B2 3/2005 Ogura et al.

(Continued)

FOREIGN PATENT DOCUMENTS

CN 1257399 A 6/2000
CN 1287766 A 3/2001

(Continued)

OTHER PUBLICATIONS

English Translation of the Written Opinion of the International Search Authority. pp. 1-5.*

(Continued)

*Primary Examiner* — Davetta W Goins
*Assistant Examiner* — Phylesha Dabney
(74) *Attorney, Agent, or Firm* — Wenderoth, Lind & Ponack, L.L.P.

(57) ABSTRACT

A piezoelectric speaker includes: a diaphragm which includes a substrate and a plurality of piezoelectric elements arranged on the substrate; and a frame for supporting the substrate at an outer peripheral portion thereof. The plural piezoelectric elements include first piezoelectric elements each having a first number of layers, and second piezoelectric elements each having a second number of layers, the first number of layers being larger than the second number of layers. Moreover, the second piezoelectric elements may be arranged farther from the center of the substrate than the first piezoelectric elements.

17 Claims, 8 Drawing Sheets

(56) References Cited

U.S. PATENT DOCUMENTS

| | | | | |
|---|---|---|---|---|
| 7,586,241 | B2 | 9/2009 | Kuroda et al. | |
| 8,014,547 | B2 | 9/2011 | Ogura et al. | |
| 8,072,119 | B2 * | 12/2011 | Engel | 310/322 |
| 2002/0186860 | A1 | 12/2002 | Ogura et al. | |
| 2003/0007653 | A1 * | 1/2003 | Azima et al. | 381/152 |
| 2004/0042628 | A1 * | 3/2004 | Kobayashi | 381/190 |
| 2008/0019544 | A1 | 1/2008 | Ogura et al. | |
| 2008/0130921 | A1 | 6/2008 | Tokuhisa et al. | |
| 2008/0218031 | A1 | 9/2008 | Kuroda et al. | |
| 2009/0096326 | A1 | 4/2009 | Onishi et al. | |

FOREIGN PATENT DOCUMENTS

| | | | |
|---|---|---|---|
| CN | 101102621 | A | 1/2008 |
| CN | 101112119 | A | 1/2008 |
| CN | 101313628 | A | 11/2008 |
| JP | 2-141096 | | 5/1990 |
| JP | 3-201799 | | 9/1991 |
| JP | 5-122793 | | 5/1993 |
| JP | 9-93696 | | 4/1997 |
| JP | 2006-211413 | | 8/2006 |
| WO | 2007/026736 | | 3/2007 |

OTHER PUBLICATIONS

International Search Report issued Jul. 19, 2011 in International (PCT) Application No. PCT/JP2011/002201.

Chinese Office Action issued Sep. 15, 2014 in corresponding Chinese Patent Application No. 201180002420.8 with partial English translation.

* cited by examiner

PIEZOELECTRIC SPEAKER

BACKGROUND OF THE INVENTION

1. Field of the Invention

The present invention relates to piezoelectric speakers using piezoelectric elements.

2. Description of the Related Art

Conventionally, there are piezoelectric speakers in each of which an electrode of a piezoelectric ceramics plate is divided so as to planarize peaks and dips of sound pressure frequency characteristics caused by resonance (for example, see Japanese Unexamined Patent Application Publication No. 5-122793). FIG. 12 is a diagram showing a conventional piezoelectric speaker disclosed in JP 5-122793.

In FIG. 12, the conventional piezoelectric speaker is equipped with a piezoelectric sounding body 1 and a frame 2 for supporting an outer peripheral portion of the piezoelectric sounding body 1. The piezoelectric sounding body 1 includes a round piezoelectric ceramics plate 3 and a metal plate 4 joined to the piezoelectric ceramics plate 3. Moreover, electrodes formed on both faces of the piezoelectric ceramics plate 3 are divided at a location determined by a high-order resonance mode. Then, a voltage lower than a voltage applied to an inside electrode 5*a* is applied to an outside electrode 5*b* located outside the position where the electrodes are divided. A technique disclosed in JP 5-122793 controls a resonance mode generated in the piezoelectric sounding body 1 by variation in the applied voltage in this way. With this, the technique disclosed in JP 5-122793 improves the peaks and dips of the sound pressure frequency characteristics.

SUMMARY OF THE INVENTION

1. Technical Problem

However, with the above mentioned conventional structure, peaks and dips are relatively reduced but stress cannot be reduced because the piezoelectric ceramics plate itself is not divided. With this, stress having a value equal to or more than a certain value is generated, which breaks the piezoelectric ceramics plate. Therefore, the conventional structure has a problem that it is difficult to reproduce with large amplitude, in other words, high sound pressure. Moreover, because, in the conventional structure, signals having different voltages or different phases need to be inputted into an outside electrode and an inside electrode, a damping device needs to be additionally provided on a lead wire to the outside electrode. With this, the conventional structure has a problem of increased costs.

The present invention has been devised in view of the above-mentioned problems and has an object to provide a piezoelectric speaker capable of improving sound characteristics and reducing costs.

2. Solution to the Problem

In order to solve the conventional problem, a piezoelectric speaker according to an aspect of the present invention includes a diaphragm including a substrate and a plurality of piezoelectric elements placed on the substrate, a frame supporting the substrate at an outer peripheral portion of the substrate, wherein the piezoelectric elements include a first piezoelectric element and a second piezoelectric element having a smaller number of layers than the number of layers of the first piezoelectric element.

With this structure, the piezoelectric speaker according to an aspect of the present invention can improve reliability because use of plural piezoelectric elements enables a decrease in stress at a time of large amplitude. Moreover, the piezoelectric speaker can reproduce sound with high sound pressure by using a piezoelectric element having a layered structure. Furthermore, the piezoelectric speaker can reduce costs while reducing deterioration in sound characteristics by appropriately placing piezoelectric elements each having a different number of layers. Moreover, the piezoelectric speaker according to an aspect of the present invention can realize an improvement of sound characteristics, such as a decrease in peaks and dips or an improvement of reliability, by appropriately placing piezoelectric elements each having a different number of layers.

Moreover, the second piezoelectric element is placed farther from the center of the substrate than the first piezoelectric element.

With this structure, the piezoelectric speaker according to an aspect of the present invention can reduce costs while reducing deterioration in sound characteristics by using piezoelectric elements each having a single layer or a relatively small number of layers on a portion having a low contribution ratio to vibration.

Moreover, the second piezoelectric element is placed on the substrate, in a portion having a larger stress than a stress at a portion on which the first piezoelectric element is placed, the stress being caused by bending vibration of the substrate.

With this structure, the piezoelectric speaker according to an aspect of the present invention can enhance a maximum input level of the piezoelectric speaker because the piezoelectric speaker can decrease amplitude in a stress-concentrated portion. Therefore, the reliability of the piezoelectric speaker can be enhanced.

Moreover, each of the piezoelectric elements includes a first electrode and a second electrode through each of which an electrical signal is applied to the piezoelectric element, and each of the piezoelectric elements has a face on which both the first electrode and the second electrode are exposed.

With this structure, the piezoelectric speaker according to an aspect of the present invention can make it easier to take out a wire lead.

Moreover, the substrate includes a third electrode and a fourth electrode which are formed by printing on a face on which the piezoelectric elements are placed, the piezoelectric elements are placed such that the face on which both the first electrode and the second electrode are exposed is in contact with the face of the substrate on which the third electrode and the fourth electrode are formed, the third electrode is connected to the first electrode included in each of the piezoelectric elements, and the fourth electrode is connected to the second electrode included in each of the piezoelectric elements.

With this structure, the piezoelectric speaker according to an aspect of the present invention can realize a leadless structure.

Moreover, the substrate is made of polyethylene terephthalate.

With this structure, the piezoelectric speaker according to an aspect of the present invention can reduce the mass of vibration of the system relative to a conventional metal diaphragm, thus making it possible for sound pressure to be enhanced.

Moreover, the substrate can be made of paper.

With this structure, the piezoelectric speaker according to an aspect of the present invention can increase internal loss of the diaphragm and therefore can reduce a quality factor Q of resonance. With this, the piezoelectric speaker can improve flatness of sound pressure characteristics.

Moreover, the substrate can be made of foam.

With this structure, the piezoelectric speaker according to an aspect of the present invention can increase internal loss of the diaphragm and therefore reduce a quality factor Q of resonance. This enables the piezoelectric speaker to enhance flatness of sound pressure characteristics.

Moreover, an edge portion is provided between the outer peripheral portion of the substrate and the frame and functions as a suspension.

With this structure, the piezoelectric speaker according to an aspect of the present invention can provide an edge regardless of a thickness of the diaphragm, making it easier to design the lowest resonance frequency.

Moreover, the edge portion has a rolled shape.

With this structure, the piezoelectric speaker according to an aspect of the present invention can reduce distortion at a time of reproduction because linearity of a support system is improved.

It is noted that the present invention can be realized not only as a piezoelectric speaker but also as audio output equipment, such as a television receiver or a mobile phone device, including this piezoelectric speaker.

3. Advantageous Effects of the Invention

The present invention can provide a piezoelectric speaker capable of realizing an improvement of sound characteristics or a decrease in costs.

DETAILED DESCRIPTION OF THE INVENTION

Hereafter, embodiments of the present invention will be described with reference to drawings.

Embodiment 1

A piezoelectric speaker according to Embodiment 1 of the present invention includes plural piezoelectric elements which are placed on a substrate. Furthermore, multilayer piezoelectric elements are placed in a central portion of the substrate and single-layer piezoelectric elements are placed on an outer peripheral portion of the substrate.

With this, the piezoelectric speaker can reduce costs while reducing deterioration in sound characteristics by using single-layer piezoelectric elements on a portion having a low contribution ratio to vibration.

Figure 1:
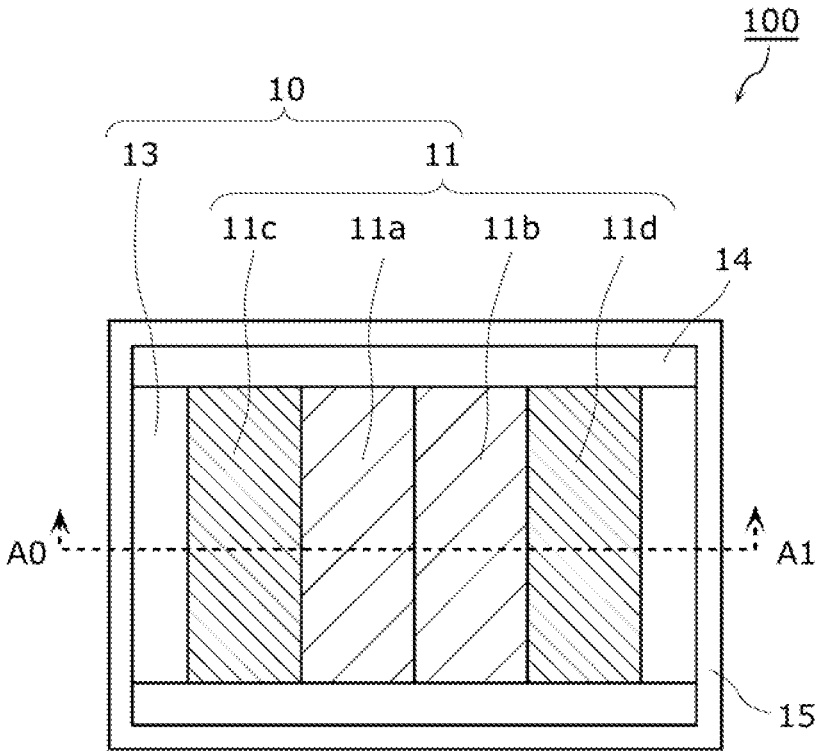
FIG. 1 is a plan view of a piezoelectric speaker according to Embodiment 1 of the present invention.

FIG. 1 is a plan view of a piezoelectric speaker 100 according to Embodiment 1 of the present invention.

Figure 2:
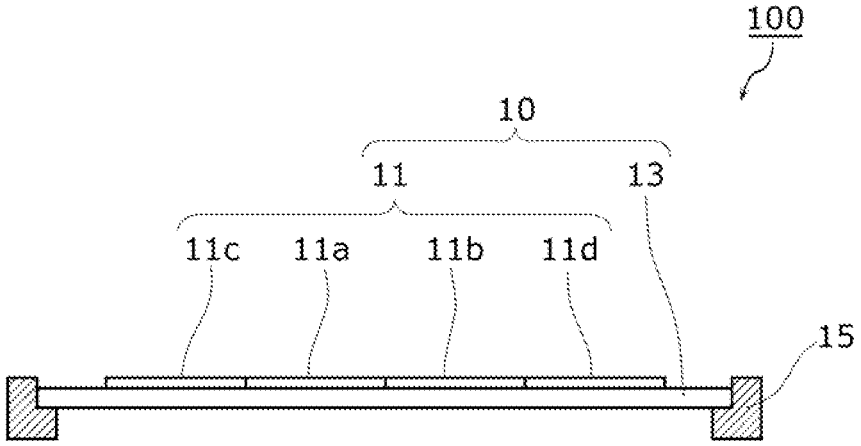
FIG. 2 is a cross-sectional view of the piezoelectric speaker according to Embodiment 1 of the present invention.

FIG. 2 is a cross-sectional view of the piezoelectric speaker 100 in a face taken along line A0-A1 of FIG. 1.

As shown in FIG. 1 and FIG. 2, the piezoelectric speaker 100 includes a diaphragm 10, a passivation film 14, and a frame 15. The diaphragm 10 includes a piezoelectric element 11 and a substrate 13.

The piezoelectric element 11 is placed on the substrate 13 and is adhered to the substrate 13. This piezoelectric element 11 is composed of four piezoelectric elements 11*a*, 11*b*, 11*c*, and 11*d*. The piezoelectric elements 11*c* and 11*d* are placed farther from the center of the substrate 13 than the piezoelectric elements 11*a* and 11*b*.

Moreover, the piezoelectric elements 11*a* and 11*b* are two-layered piezoelectric elements. The piezoelectric elements 11*c* and 11*d* are single-layer piezoelectric elements. Moreover, a thickness of each of the piezoelectric elements is equal in the present embodiment. Moreover, a thickness may be different between a two-layer piezoelectric element and a single-layer piezoelectric element.

Figure 3A:
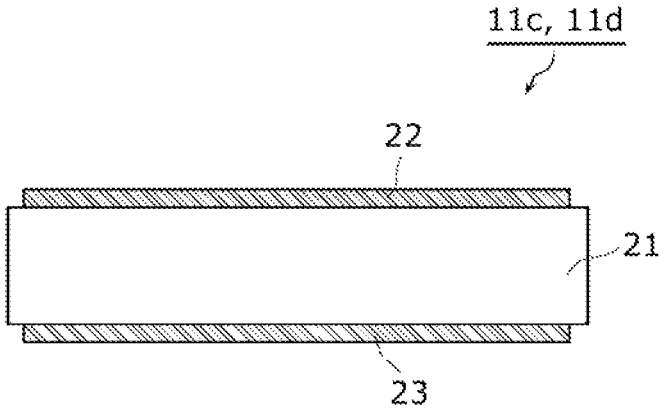
FIG. 3A is a cross-sectional view of a single-layer piezoelectric element according to Embodiment 1 of the present invention.
Figure 3B:
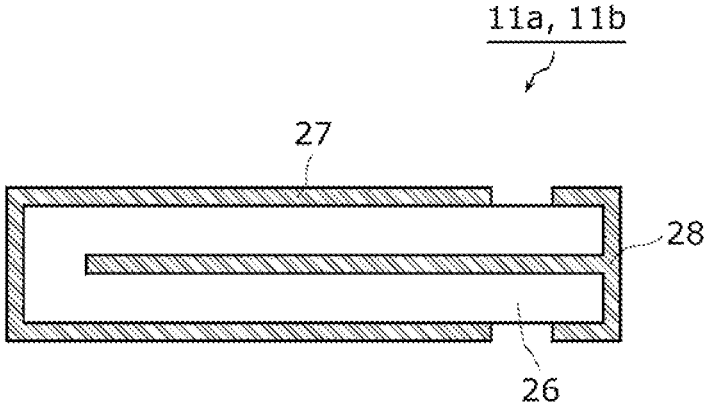
FIG. 3B is a cross-sectional view of a multilayer piezoelectric element according to Embodiment 1 of the present invention.

FIG. 3A is a cross-sectional view of the single-layer piezoelectric elements 11*c* and 11*d*. FIG. 3B is a cross-sectional view of the multilayer piezoelectric elements 11*a* and 11*b*.

As shown in FIG. 3A, each of the single-layer piezoelectric elements 11*c* and 11*d* includes a piezoelectric ceramics layer 21 and electrodes 22 and 23. The electrodes 22 and 23 are placed on and under the piezoelectric ceramics layer 21 such that the electrodes 22 and 23 hold the piezoelectric ceramics layer 21 therebetween.

The multilayer piezoelectric elements 11*a* and 11*b* are elements in each of which a piezoelectric ceramics layer and an electrode are alternately layered. As shown in FIG. 3B, the multilayer piezoelectric elements 11*a* and 11*b* each includes a piezoelectric ceramics layer 26 and electrodes 27 and 28. The electrode 28 is an electrode layer which functions as an inside electrode. The piezoelectric ceramics layer 26 is composed of two layers, and the electrode 28 is sandwiched between the two layers. The electrode 27 is configured to vertically hold the whole of the piezoelectric ceramics layer 26 composed of two layers.

Figure 3C:
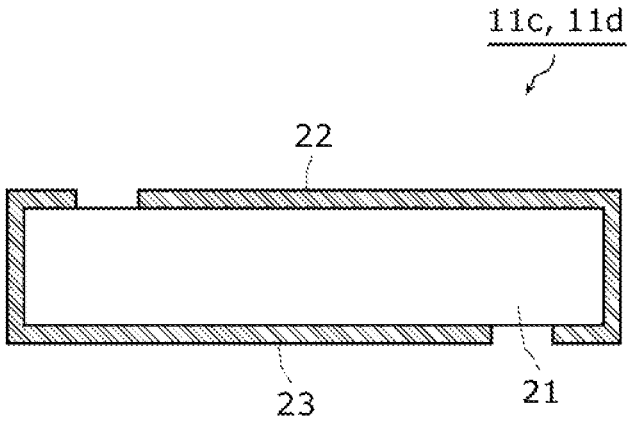
FIG. 3C is a cross-sectional view of the single-layer piezoelectric element according to Embodiment 1 of the present invention.

It is noted that a structure as shown in FIG. 3C may be used as a structure of each of the single-layer piezoelectric elements 11*c* and 11*d*.

The frame 15 supports both edges of the diaphragm 10. Moreover, in FIG. 1, a gap is provided between the frame 15 and both edges in a longitudinal direction of the diaphragm 10. It is noted that the frame 15 may support four sides of the diaphragm 10.

The passivation film 14 is formed to cover the gap. It is noted that the passivation film 14 is provided to block sound radiated from a reverse side of the diaphragm 10. This passivation film 14 is, for example, a film of styrene butadiene rubber (SBR). It is noted that the passivation film 14 may be provided only on an upper portion of a gap so as to fill the gap between the diaphragm 10 and the frame 15 and may be provided to cover the upper portion of the gap and the whole of the diaphragm 10.

It is noted that a method of driving the diaphragm 10 by applying a driving voltage to a surface electrode (not illustrated) of the piezoelectric element 11 is similar to the conventional piezoelectric speaker.

Here, when the driving voltage is applied to the piezoelectric element 11, a dome-shaped vibration mode occurs such that amplitude in the central portion of the diaphragm 10 is largest. Based on this vibration mode, a multilayer piezoelectric element having a large amount of distortion is used for the piezoelectric elements 11*a* and 11*b* having a high contribution ratio to amplitude, while a single-layer piezoelectric element having a small amount of distortion is used for the piezoelectric elements 11*c* and 11*d* having a low contribution ratio.

Figure 4A:
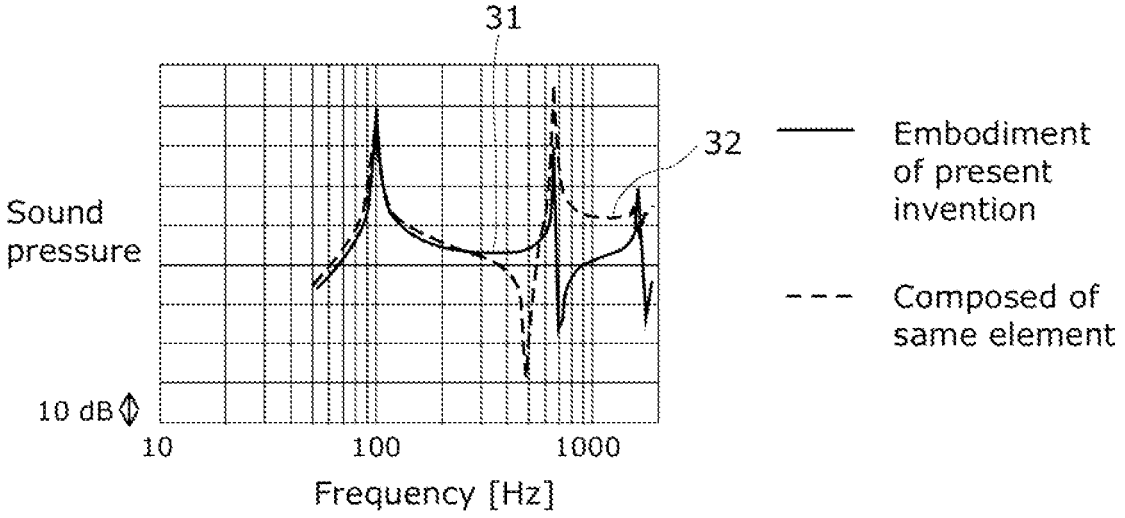
FIG. 4A is a graph showing sound pressure frequency characteristics of the piezoelectric speaker having a monomorph structure according to Embodiment 1 of the present invention.

FIG. 4A shows sound pressure frequency characteristics of the piezoelectric speaker 100 composed as mentioned above. In FIG. 4A, a horizontal axis represents frequency and a vertical axis represents sound pressure. Sound pressure frequency characteristics 31, as shown in a solid line, represent characteristics of the piezoelectric speaker 100 according to Embodiment 1 of the present invention, and sound pressure frequency characteristics 32, as shown in a dotted line, represent characteristics in a case where a multilayer piezoelectric element is used for all piezoelectric elements. As shown in FIG. 4A, sound pressure of the piezoelectric speaker 100 according to Embodiment 1 of the present invention is almost equal to sound pressure in the case where the multilayer piezoelectric element is used for all piezoelectric elements. Furthermore, a dip occurring around 500 Hz is eliminated by introducing a structure of a combination of a multilayer piezoelectric element with a single-layer piezoelectric element. In other words, the combination of the single-layer piezoelectric element with the multilayer piezoelectric element enables control of a resonance mode.

In this way, the combination of the single-layer piezoelectric element with the multilayer piezoelectric element enables characteristics to be similar to characteristics in a case of only the multilayer piezoelectric element, making it possible to further control the resonance mode. Moreover, element costs and power consumption can be reduced by addition of single-layer piezoelectric elements.

Moreover, the conventional piezoelectric speaker is composed of a sheet of the piezoelectric element 3, while in the piezoelectric speaker 100 according to Embodiment 1 of the present invention, the piezoelectric element 11 is divided into four sheets, thus allowing stress at a time of distortion to be reduced. For example, in the case where a piezoelectric element is divided into four sheets, the stress at a time of amplitude is decreased by around 20% compared with the case where a sheet of piezoelectric element is used. Therefore, the piezoelectric speaker 100 can also gain an effect of increasing the reliability.

Figure 4B:
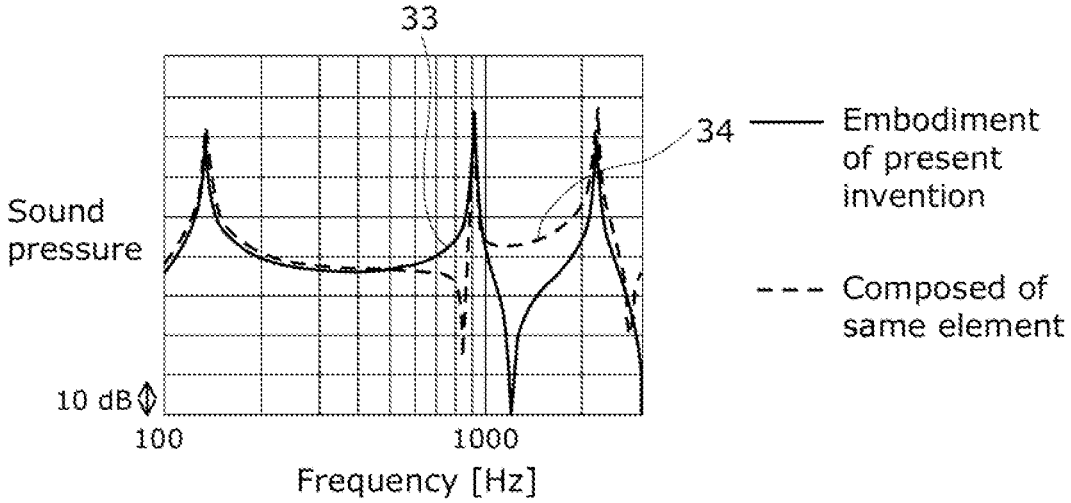
FIG. 4B is a graph showing sound pressure frequency characteristics of the piezoelectric speaker having a bimorph structure according to Embodiment 1 of the present invention.

It is noted that in the above-mentioned description, a monomorph structure in which the piezoelectric element 11 is placed on only an upper side of the substrate 13 is described as an example, but there may be a bimorph structure in which the piezoelectric element is placed also on a reverse side. FIG. 4B is a graph showing sound pressure frequency characteristics in the case where the bimorph structure is used. Sound pressure frequency characteristics 33, as shown in a solid line, represent characteristics of the piezoelectric speaker according to Embodiment 1 of the present invention, and sound pressure frequency characteristics 34, as shown in a dotted line, represent characteristics in the case where a multilayer piezoelectric element is used for all piezoelectric elements. As shown in FIG. 4B, it is possible to gain an effect in a bimorph structure similar to the monomorph structure.

Figure 5:
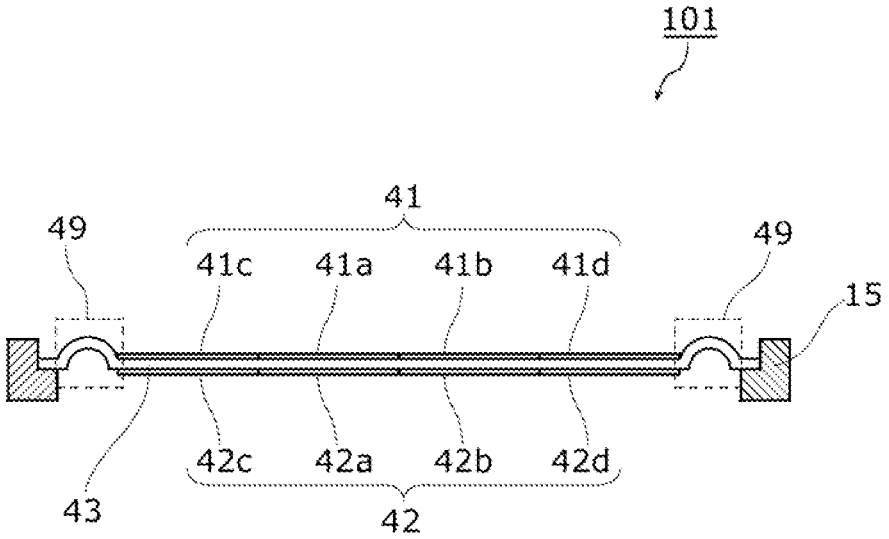
FIG. 5 is a cross-sectional view of the piezoelectric speaker in the case where a rolled edge is used according to Embodiment 1 of the present invention.

Moreover, in the above-mentioned description, the substrate 13 is a flat configuration, but there may be a configuration as shown in FIG. 5. FIG. 5 is a cross-sectional view of a piezoelectric speaker 101 according to a variation of Embodiment 1 of the present invention. This piezoelectric speaker 101, different from the piezoelectric speaker 100 shown in FIG. 2, includes a substrate 43 and piezoelectric elements 41 and 42 instead of the diaphragm 10. It is noted that in FIG. 5, a bimorph structure is exemplified.

The piezoelectric element 41 is placed on a surface of the substrate 43. This piezoelectric element 41 includes multilayer piezoelectric elements 41*a* and 41*b* and single-layer piezoelectric elements 41*c* and 41*d*.

The piezoelectric element 42 is placed on a reverse face of the substrate 43. This piezoelectric element 42 includes multilayer piezoelectric elements 42*a* and 42*b* and single-layer piezoelectric elements 42*c* and 42*d*.

The substrate 43 includes a region on which the piezoelectric element 41 and the piezoelectric element 42 are placed and an edge portion 49 which is an outer peripheral portion of the substrate 43 and functions as a suspension. This edge portion 49 has a rolled shape as shown in FIG. 5. Hence, use of the edge portion 49 having a rolled shape enables an increase in linearity of an amount of amplitude relative to an input voltage. With this, distortion can be realized.

It is noted that in FIG. 5, the edge portion 49 is a portion of the substrate 43, but may be composed of a separate component independent from the substrate 43. In this case, the edge portion 49 is provided between the outer peripheral portion of the substrate 43 and the frame 15 and functions as a suspension for supporting the outer peripheral portion of the substrate 43 and the frame 15. Moreover, this edge portion 49 may be connected all around between the substrate 43 and the frame 15. Moreover, in this case, the passivation film 14 may not be used. As a result, it becomes easier to design the lowest resonance frequency f0. Moreover, a bimorph structure is exemplified in FIG. 5 but a monomorph structure may be used.

Moreover, in the above-mentioned description, a two-layer piezoelectric element and a single-layer piezoelectric element are combined, but a different number of layers, such as two layers and four layers, is acceptable according to necessary characteristics. It is noted as described above, deterioration in sound characteristics can be reduced and costs can be reduced by placing piezoelectric elements having a large number of layers on the central portion of the substrate 13 and placing piezoelectric elements having a small number of layers on the outer peripheral portion of the substrate 13.

Moreover, a plurality of piezoelectric elements which have three or more different number of layers, such as a single layer, two layers, and four layers, may be combined. In this case, the number of layers may be increased when the piezoelectric elements are closer to the central portion of the substrate 13.

Moreover, in the above description, four sheets of piezoelectric elements are used, but the number of elements may be increased so as to finely control a resonance mode. In other words, the present invention can be applied to a case where two or more sheets of piezoelectric elements are used.

Moreover, in the above description, a structure shown in FIG. 3B is exemplified as a multilayer piezoelectric element, but a stack of single-layer piezoelectric elements may be used as a multilayer piezoelectric element.

Embodiment 2

A piezoelectric speaker according Embodiment 2 of the present invention includes piezoelectric elements placed on a substrate. Furthermore, single-layer piezoelectric elements are placed on a portion having large stress caused by bending vibration of the substrate and multilayer piezoelectric elements are placed on a portion having small stress caused by bending vibration of the substrate.

With this structure, the piezoelectric speaker can reduce amplitude of stress concentrated in a portion and can enhance reliability of the piezoelectric speaker.

Figure 6:
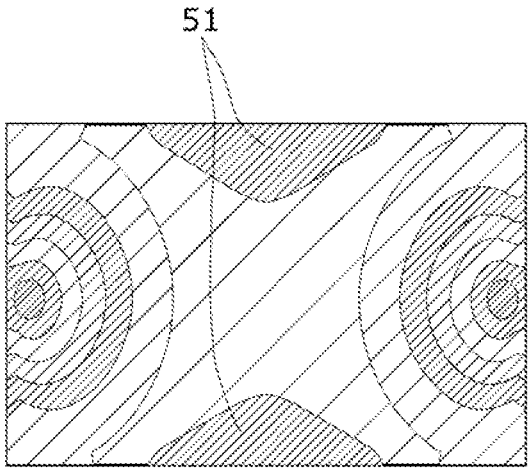
FIG. 6 is a diagram showing a distribution of stress in a piezoelectric element according to Embodiment 2 of the present invention.

FIG. 6 is a diagram showing a distribution of stress generated in the case where only a sheet of a piezoelectric element is used. In FIG. 6, stress in a portion 51 is higher than stress in other portions.

Figure 7A:
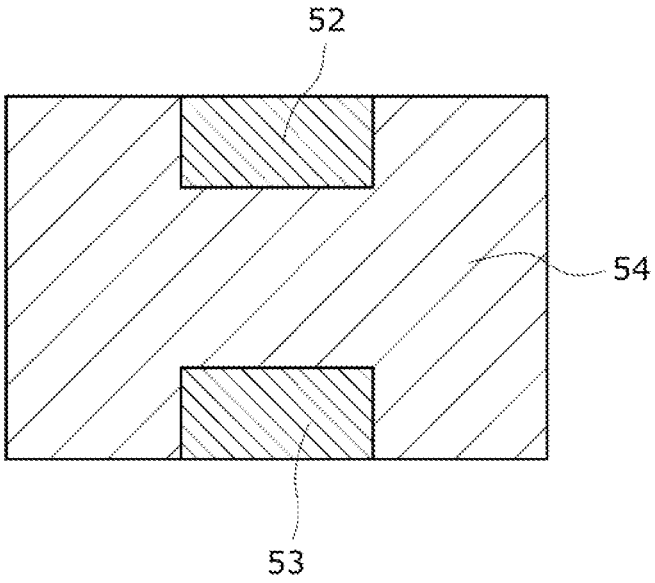
FIG. 7A is a diagram showing configurations and locations of piezoelectric elements according to Embodiment 2 of the present invention.

In Embodiment 2 of the present invention, piezoelectric elements having a smaller number of layers than piezoelectric elements in the other portions are placed on the portion 51 having high stress. This enables stress generated in the portion 51 to be reduced, thus leading to an improvement of reliability. FIG. 7A is a diagram showing locations of piezoelectric elements according to Embodiment 2 of the present invention. The piezoelectric elements 52 and 53 shown in FIG. 7A have a smaller number of layers than the piezoelectric element 54. For example, the piezoelectric elements 52 and 53 are single-layer piezoelectric elements and the piezoelectric element 54 is a multilayer piezoelectric element.

Figure 7B:
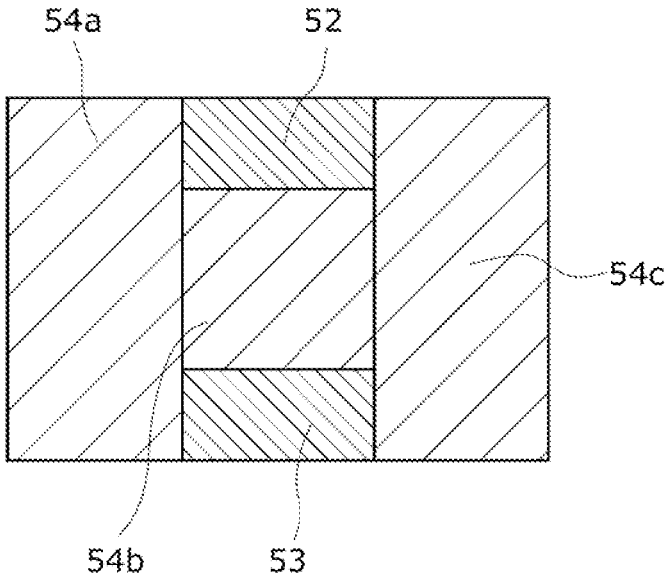
FIG. 7B is a diagram showing an example of variations in configurations and locations of the piezoelectric elements according to Embodiment 2 of the present invention.

It is noted that in FIG. 7A, the piezoelectric element 54 is composed of one sheet, but the piezoelectric element 54 may be composed of, for example, three sheets of piezoelectric elements for easy implementation. FIG. 7B is a diagram showing the locations of piezoelectric elements in this case. The piezoelectric elements 52 and 53 shown in FIG. 7B have a smaller number of layers than the piezoelectric elements 54*a*, 54*b*, and 54*c*. For example, the piezoelectric elements 52 and 53 are single-layer piezoelectric elements and the piezoelectric elements 54*a*, 54*b*, and 54*c* are multilayer piezoelectric elements.

Embodiment 3

In Embodiment 3 of the present invention, a method of electrically connecting the piezoelectric element 11 to the substrate will be described. Moreover, hereafter, a case where the piezoelectric element 11 is used as described in Embodiment 1 will be described as an example, but a similar structure can be applied to the piezoelectric elements described in Embodiment 2.

Figure 8:
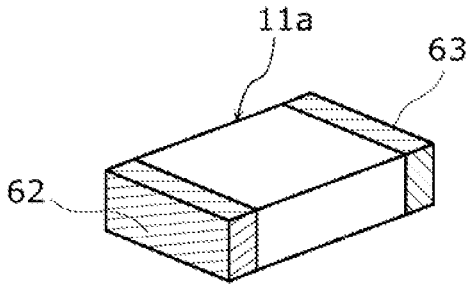
FIG. 8 is a perspective view of a piezoelectric element according to Embodiment 3 of the present invention.
Figure 9:
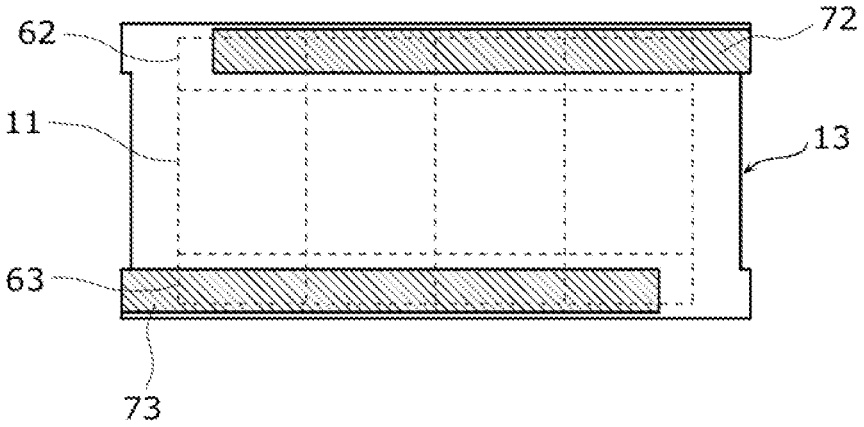
FIG. 9 is a top view of a substrate according to Embodiment 3 of the present invention.

FIG. 8 is a perspective view of the piezoelectric element 11*a*. FIG. 9 is a top view of the substrate 13.

It is noted that the whole structure of the piezoelectric speaker is similar to Embodiment 1 as shown, for example, in FIG. 1 and FIG. 2.

A difference from Embodiment 1 is an electrode structure of the piezoelectric element 11 and that electrodes are formed by printing on the substrate 13. Moreover, a material of the substrate 13, for example, is polyethylene terephthalate (PET). Moreover, hereafter will be described an electrode structure of a piezoelectric element with reference to the piezoelectric element 11*a*, but structures of piezoelectric elements 11*b* to 11*d* are also similar to a structure of the piezoelectric element 11*a*.

As shown in FIG. 8, in the piezoelectric element 11*a*, a positive electrode 62 and a negative electrode 63 are formed on both sides of the piezoelectric element 11*a* so as to apply an electric signal to the piezoelectric element 11*a*. Here, a pair of the electrodes 62 and 63 is equivalent to a pair of the electrodes 27 and 28 as shown in FIG. 3B or a pair of the electrodes 22 and 23 shown in FIG. 3C. Moreover, at least a portion of a surface of the electrodes 62 and 63 is exposed to the substrate 13 side face of the piezoelectric element 11*a*. In other words, the piezoelectric element 11*a* has the face in which both the electrodes 62 and 63 are exposed. In an example shown in FIG. 8, there are four faces of the piezoelectric element 11*a* in which faces of both the electrodes 62 and 63 are exposed.

As a result, wiring of lead wire and the like becomes easier because an electrode can be connected from the same face on the piezoelectric element 11*a*.

Moreover, as shown in FIG. 9, the substrate 13 has two electrodes 72 and 73 formed on a surface of the substrate 13. These electrodes 72 and 73 are formed by printing on a face on which the piezoelectric element 11 is placed.

Moreover, the piezoelectric elements 11*a* to 11*d* are placed such that the face on which both the electrodes 62 and 63 are exposed is in contact with the face on which the electrodes 72 and 73 of the substrate 13 are formed. Moreover, each of the electrodes 62 and 63 of the piezoelectric element 11*a* shown in FIG. 8 is placed on the electrodes 72 and 73 on the substrate 13 and is connected to the electrodes 72 and 73. This allows conduction of the electrodes 62 and 63 to the electrodes 72 and 73. In other words, the electrode 72 is electrically connected to plural electrodes 62 which are included in the piezoelectric elements 11*a* to 11*d*. The electrode 73 is electrically connected to the plural electrodes 63 which are included in the piezoelectric elements 11*a* to 11*d*.

In other words, a combination of the piezoelectric elements 11*a* to 11*d* with the substrate 13 makes it possible to realize a leadless structure. As a result, also in the case of placing piezoelectric elements, assembly becomes easier by formation by printing, on a diaphragm, of an electrode corresponding to the pattern.

Moreover, while the conventional piezoelectric speaker uses metal as a substrate, PET resin is used for the substrate 13 in Embodiment 3 of the present invention. This makes the substrate 13 lighter, making it possible to obtain an effect of efficiency improvement. Moreover, resin has greater internal loss than metal. As a result, a quality factor (Q) of resonance of sound pressure characteristics can be reduced and therefore sound quality can be improved.

It is noted in the above-mentioned description, PET resin is used as a material of the substrate 13, but other materials can be used as long as they are materials on which an electrode can be printed. For example, paper or foam can be used as a material of the substrate 13. Use of paper or foam can realize lighter weight or higher internal loss, thus making it possible to realize higher efficiency and higher sound quality. Moreover, a strength of adhesion of electrodes can be increased, and therefore reliability also becomes higher.

Moreover, in the above-mentioned description, the two electrodes 62 and 63 of the piezoelectric element 11*a* are formed on both sides of the element, but a structure other than the structure described above is acceptable as long as it is a structure in which both electrodes are exposed together on at least one face.

The piezoelectric speaker according to the embodiments of the present invention has been described above, but the present invention is not limited to the embodiments described above.

Figure 10:
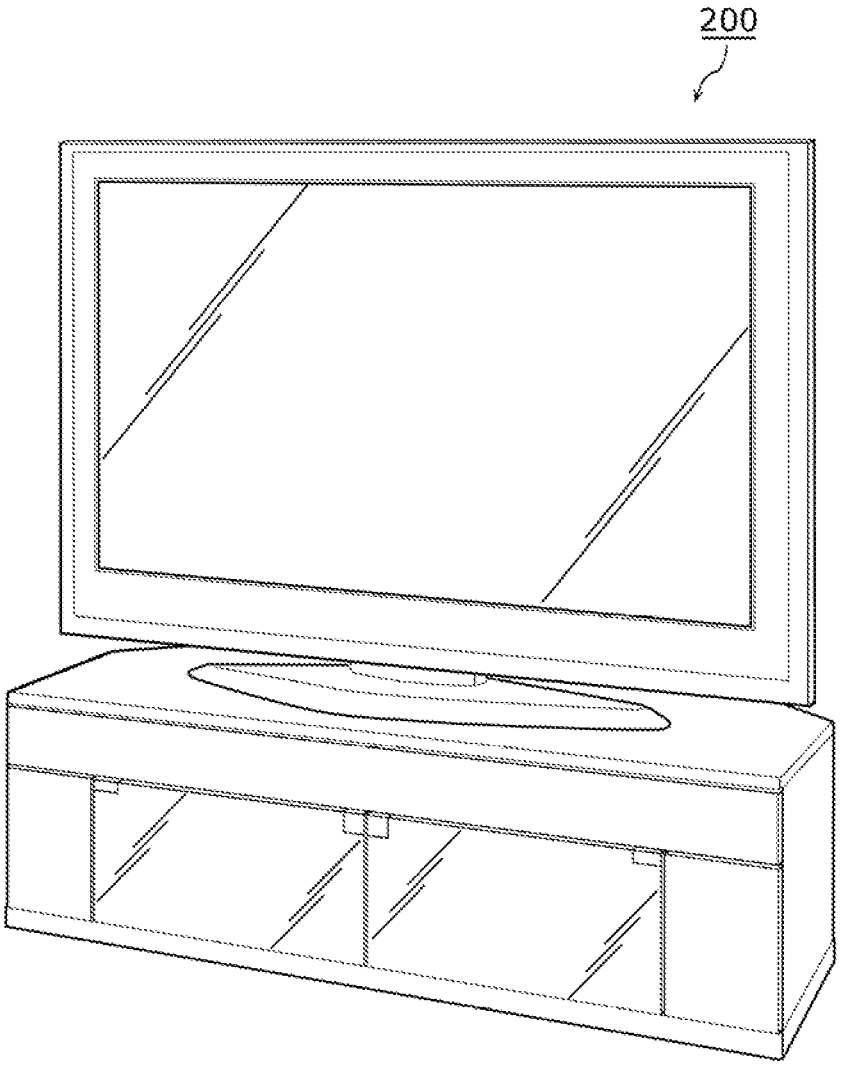
FIG. 10 is a diagram showing a television receiver according to the embodiments of the present invention.
Figure 11:
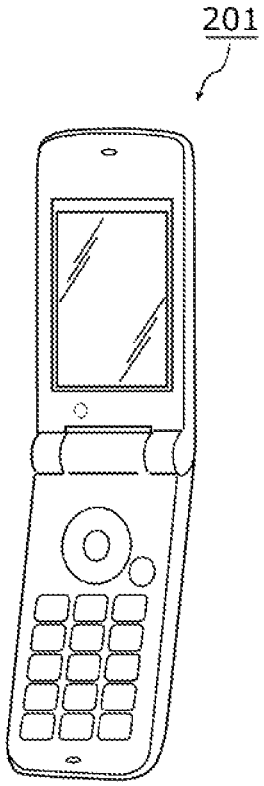
FIG. 11 is a diagram showing a mobile phone device according to the embodiments of the present invention.
Figure 12:
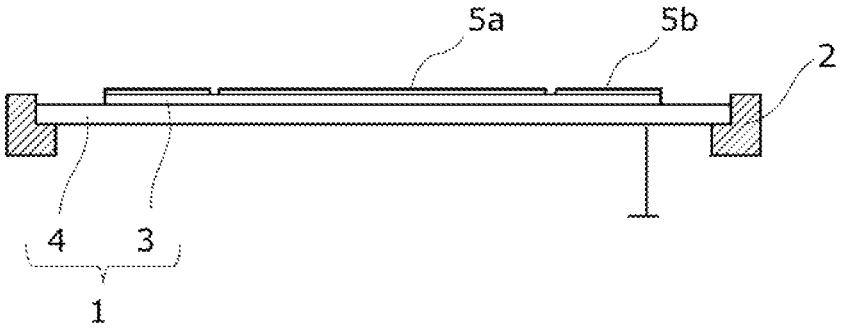
FIG. 12 is a cross-sectional view of a conventional piezoelectric speaker.

For example, the present invention can be realized as audio equipment including the above-mentioned piezoelectric speaker. For example, the present invention can be realized as a television receiver 200, as shown in FIG. 10, including the above mentioned piezoelectric speaker and as a mobile phone device 201, as shown in FIG. 11, including the above mentioned piezoelectric speaker. Moreover, a piezoelectric speaker according to the present invention can be used in a speaker for a home theater or a speaker for an automobile.

Moreover, in each of the above described drawings, corner portions and sides of each component are linearly described, but the present invention also includes components including corner portions and sides that are round due to manufacturing considerations.

Moreover, at least a portion of configurations of piezoelectric speakers according to Embodiments 1 to 3 and variations thereof may be combined.

Moreover, all values used in the above descriptions are exemplified to describe the present invention in detail and the present invention is not limited to the exemplified values. Moreover, materials of each of the components exemplified above are exemplified to describe the present invention in detail and the present invention is not limited to the exemplified materials.

As long as there is no departure from the spirit and scope of the present invention, variations of the embodiments conceived by those skilled in the art also fall within the scope of the present invention.

The present invention can be applied to a piezoelectric speaker. Moreover, the present invention can also be applied to a flat panel television receiver, a mobile phone device, a speaker for a home theater, and a speaker for an automobile, all of which use a piezoelectric speaker.

REFERENCE SIGNS LIST

1 Piezoelectric sounding body
2 Frame
3 Piezoelectric ceramics plate
4 Metal plate
5*a* Inside electrode
5*b* Outside electrode
10 Diaphragm
11, 11*a*, 11*b*, 11*c*, 11*d*, 41, 41*a*, 41*b*, 41*c*, 41*d*, 42, 42*a*, 42*b*, 42*c*, 42*d*, 52, 53, 54, 54*a*, 54*b*, 54*c* Piezoelectric element
13, 43 Substrate
14 Passivation film
15 Frame
21, 26 Piezoelectric ceramics layer
22, 23, 27, 28, 62, 63, 72, 73 Electrode
31, 32, 33, 34 Sound pressure frequency characteristics
49 Edge portion
51 Portion
100, 101 Piezoelectric speaker
200 Television receiver
201 Mobile phone device

The invention claimed is:

1. A piezoelectric speaker comprising:

a diaphragm including a substrate and a plurality of piezoelectric elements arranged on said substrate; and a frame supporting said substrate at an outer peripheral portion of said substrate, wherein each of said plurality of piezoelectric elements includes at least one piezoelectric body and at least one electrode, the at least one piezoelectric body and the at least one electrode being stacked, wherein said plurality of piezoelectric elements includes a first piezoelectric element having a first number of layers, and second and third piezoelectric elements, each having a second number of layers, the first number of layers being larger than the second number of layers, wherein said first piezoelectric element has a first contribution ratio to amplitude, and said second and third piezoelectric elements each have a second contribution ratio to amplitude, the first contribution ratio to amplitude being larger than the second contribution ratio to amplitude such that a distortion of said first piezoelectric element is larger than a distortion of each of said second and third piezoelectric elements, wherein said first piezoelectric element is arranged on said substrate in a portion having a first stress, said second piezoelectric element is arranged on said substrate in a portion having a second stress, and said third piezoelectric element is arranged on said substrate in a portion having a third stress equal to the second stress, the first stress being smaller than the each of the second and third stresses, wherein the first, second, and third stresses are caused by a bending vibration of said substrate, and wherein said second piezoelectric element and said third piezoelectric element are symmetrically arranged with respect to a center of said substrate.

2. The piezoelectric speaker according to claim 1, wherein said second piezoelectric element and said third piezoelectric element are arranged farther from the center of said substrate than said first piezoelectric element.

3. The piezoelectric speaker according to claim 1, wherein each at least one electrode includes a first electrode and a second electrode through each of which an electrical signal is applied to said respective piezoelectric element, and wherein each of said plurality of piezoelectric elements has a face on which both said first electrode and said second electrode of said respective piezoelectric element are exposed.

4. The piezoelectric speaker according to claim 3, wherein said substrate includes a third electrode and a fourth electrode which are formed by printing on a face on which said plurality of piezoelectric elements is arranged, wherein said plurality of piezoelectric elements is arranged such that the face on which both said first electrode and said second electrode are exposed is in contact with the face of said substrate on which said third electrode and said fourth electrode are formed, wherein said third electrode is connected to said first electrode included in each of said plurality of piezoelectric elements, and wherein said fourth electrode is connected to said second electrode included in each of said plurality of piezoelectric elements.

5. The piezoelectric speaker according to claim 1, wherein said substrate is made of polyethylene terephthalate.

6. The piezoelectric speaker according to claim 1, wherein said substrate is made of paper.

7. The piezoelectric speaker according to claim 1, wherein said substrate is made of foam.

8. The piezoelectric speaker according to claim 1, further comprising an edge portion which is provided between the outer peripheral portion of said substrate and said frame and which functions as a suspension.

9. The piezoelectric speaker according to claim 8, wherein said edge portion has a rolled shape.

10. A television receiver comprising a piezoelectric speaker according to claim 1.

11. A mobile phone device comprising a piezoelectric speaker according to claim 1.

12. The piezoelectric speaker according to claim 1, wherein said first piezoelectric element is arranged between said second piezoelectric element and said third piezoelectric element, and said first piezoelectric element is arranged over the center of said substrate.

13. The piezoelectric speaker according to claim 12, wherein said first piezoelectric element includes two piezoelectric elements, and said two piezoelectric elements of said first piezoelectric element are symmetrically arranged with respect to the center of said substrate.

14. The piezoelectric speaker according to claim 1, wherein each of said second piezoelectric element and said third piezoelectric element includes a three-layer structure comprising two electrode layers and one piezoelectric body layer, and wherein said first piezoelectric element includes a five-layer structure comprising three electrode layers and two piezoelectric body layers.

15. The piezoelectric speaker according to claim 1, wherein each of said plurality of piezoelectric elements comprises a surface having a rectangular shape, each of the surfaces being arranged on said substrate, and wherein said first piezoelectric element and said second piezoelectric element are arranged such that a longitudinal side of the rectangular surface of said first piezoelectric element is in contact with a longitudinal side of the rectangular surface of said second piezoelectric element.

16. The piezoelectric speaker according to claim 1, wherein, when a driving voltage is applied to said plurality of piezoelectric elements, a vibration mode occurs such that an amplitude in a central portion of said diaphragm is largest.

17. The piezoelectric speaker according to claim 16, wherein said vibration mode is dome-shaped.

* * * * *